US009455098B2

(12) United States Patent
Lunden et al.

(10) Patent No.: US 9,455,098 B2
(45) Date of Patent: Sep. 27, 2016

(54) ELECTRICAL CIRCUIT SWITCH WITH VARIABLE GEAR RATIO

(71) Applicant: ABB Schweiz AG, Baden (CH)

(72) Inventors: Bjorn Lunden, Jarfalla (SE); David Karlen, Vasteras (SE); Arne Trangard, Vasteras (SE); Stefan Lunderius, Uppsala (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/502,427

(22) Filed: Sep. 30, 2014

(65) Prior Publication Data

US 2015/0054607 A1 Feb. 26, 2015

Related U.S. Application Data

(63) Continuation of application No. PCT/EP2012/055887, filed on Mar. 30, 2012.

(51) Int. Cl.

| | |
|---|---|
| ***H01H 3/00*** | (2006.01) |
| ***H01H 3/32*** | (2006.01) |
| ***H01H 3/46*** | (2006.01) |
| *H01H 1/20* | (2006.01) |
| *H01H 31/24* | (2006.01) |

(52) U.S. Cl.

CPC ..... *H01H 3/32* (2013.01); *H01H 3/46* (2013.01); *H01H 1/20* (2013.01); *H01H 31/24* (2013.01); *H01H 2003/326* (2013.01)

(58) Field of Classification Search

CPC ..... H01H 3/46; H01H 3/32; H01H 1/20; H01H 2003/326; H01H 31/24

USPC ..... 335/185, 189–191

See application file for complete search history.

(56) References Cited

U.S. PATENT DOCUMENTS

| | | | | |
|---|---|---|---|---|
| 2,601,422 | A * | 6/1952 | Thumim | H01H 71/2418 200/244 |
| 3,992,600 | A | 11/1976 | Heutschi et al. | |
| 4,180,788 | A * | 12/1979 | Barkan | H01H 33/666 335/190 |
| 4,472,615 | A * | 9/1984 | Itoh | H01H 9/0027 200/244 |

(Continued)

FOREIGN PATENT DOCUMENTS

| | | |
|---|---|---|
| CN | 101702388 A | 5/2010 |
| CN | 101752133 Z | 6/2010 |

(Continued)

OTHER PUBLICATIONS

International Preliminary Report on Patentability Application No. PCT/EP2012/055887 Completed: Mar. 21, 2014 9 pages (Continued)

*Primary Examiner* — Bernard Rojas
(74) *Attorney, Agent, or Firm* — Whitmyer IP Group LLC

(57) ABSTRACT

An electrical circuit switch including: a first movable element configured for being movable by a force applied to the first movable element, the force having a direction parallel to a first axis; and a second movable element including a movable contact and being configured for, by means of the force, moving the movable contact in parallel to a second axis between an open and a closed position, corresponding to the switch opening or closing an electrical circuit. The first axis forms an angle to the second axis and the first movable element and the second movable element are pivotally arranged to each other in a first joint.

17 Claims, 3 Drawing Sheets

(56) References Cited

U.S. PATENT DOCUMENTS

| | | | | |
|---|---|---|---|---|
| 4,791,250 | A * | 12/1988 | Yin | H01H 3/30 200/17 R |
| 5,140,117 | A * | 8/1992 | Vianson | H01H 3/30 200/400 |
| 5,541,378 | A | 7/1996 | Niklaus | |
| 5,650,603 | A * | 7/1997 | Pfaff | H02B 13/075 218/55 |
| 6,384,356 | B1 * | 5/2002 | Postmus | H01H 5/04 200/318 |
| 2009/0032500 | A1 * | 2/2009 | Kobayashi | H01H 33/666 218/140 |
| 2011/0155555 | A1 | 6/2011 | Cortinovis et al. | |

FOREIGN PATENT DOCUMENTS

| | | | |
|---|---|---|---|
| DE | 1490509 | A1 | 6/1969 |
| EP | 0682353 | A1 | 11/1995 |
| FR | 2135715 | A5 | 12/1972 |

OTHER PUBLICATIONS

International Search Report and Written Opinion of the International Searching Authority Application No. PCT/EP2012/055887 Completed: Nov. 27, 2012; Mailing Date: Dec. 7, 2012 8 pages.

* cited by examiner

ELECTRICAL CIRCUIT SWITCH WITH VARIABLE GEAR RATIO

FIELD OF THE INVENTION

The invention relates to an electrical circuit switch and a method thereof for moving a movable contact in order to open or close an electrical circuit.

BACKGROUND OF THE INVENTION

A contactor is an electrically controlled switch used for switching an electrical circuit. An electromagnet is used for closing the electrical circuit by forcing a moving contact into electrical contact with a stationary contact. Energy for the closing operation is typically transferred from an electromagnet to the moving contact by a mechanical mechanism. The mechanism could either have a direct connection or a fixed gear ratio. The moving and stationary contacts may be worn and their electrical lifetimes may be reduced by the moving contact meeting the stationary contact with high speed and contact bounces may be created, which may give rise to arcs that reduces the electrical lifetime.

To have a variable speed on a transferring mechanism is shown in documents US 2011/0155555, U.S. Pat. No. 5,541,378, U.S. Pat. No. 3,992,600 and CN 101702388, which documents disclose how to dampen the closing of a switch. The solution according to US 2011/0155555 is to use a sliding element with different slopes. In U.S. Pat. No. 5,541,378, a drive device based on a cam disk with a curved path is used. In U.S. Pat. No. 3,992,600, a rod with a lever and a second mass are used in order to affect the speed of the switch and in CN 101702388 which is used in an arc extinguishing chamber, connecting rods are movable in a curved path. These disclosures represent alternative solutions, each with its own advantages and disadvantages.

SUMMARY OF THE INVENTION

It is an objective of the present invention to at least alleviate a problem with the prior art.

According to an aspect of the present invention, there is provided an electrical circuit switch comprising: a first movable element configured for being movable by a force applied to said first movable element, said force having a direction parallel to a first axis; and a second movable element comprising a movable contact and being configured for, by means of said force, moving said movable contact in parallel to a second axis between an open and a closed position, corresponding to the switch opening or closing an electrical circuit; wherein the first axis forms an angle to the second axis; and wherein the first movable element and the second movable element are pivotally arranged to each other in a first joint.

According to another aspect of the present invention, there is provided a method of an electrical circuit switch comprising a first movable element pivotally arranged to a second movable element in a first joint, the method comprising: applying a force to the first movable element in a direction parallel to a first axis, such that the force is transmitted to the second element via the first joint and moves a movable contact of the second element in parallel to a second axis and into contact with a fixed contact, thereby closing an electrical circuit, wherein the first axis forms an angle to the second axis; and holding the movable contact in contact with the fixed contact by means of applying the force to the first element.

The device aspect of the present invention may be used for performing the method aspect of the present invention.

By the first and second axes forming an angle (not being parallel to each other), i.e. by the direction of the applied force having a direction other than the direction in which the movable contact moves as a result of the applied force, and by the first and second elements being pivotally arranged to each other, the ratio of the movement parallel to the first axis of the section of the first element on which the force is applied and the movement of the movable contact parallel to the second axis, may be variable. The movement ratio may be controlled e.g. by choosing the angle between the first and second axes or by the design of the first and second elements. The switch may also be made with a more compact design since it may be made smaller in the direction of the movement of the movable switch. An additional advantage is that the applied force needed for holding the movable contact in contact with the fixed contact may be reduced.

The discussions above and below in respect of any of the aspects of the invention are also in applicable parts relevant to any other aspect of the present invention.

The present invention may be especially suitable if the switch is a contactor, but also other types of switches may benefit from the present invention.

In some embodiments of the present invention, the first axis forms a right angle to the second axis. This may simplify the design of the inventive switch.

The force applied to the first element of the switch may be an electromagnetic force, i.e. a force produced by an electromagnet and applied to a section of the first element, but also other types of actuators are considered.

In some embodiments of the present invention, the first movable element comprises a first part and a second part, the first and second parts being pivotally arranged to each other in a second joint. The first part may be configured for having the force applied to it and the second part may be the part which is pivotally arranged to the second element in the first joint and able to transmit the force from the first part to the second element via the second and first joints. By dividing the first element into at least two, to each other pivotally arranged, parts, the movement of the movable contact as a result of the applied force may be additionally controlled, e.g. by adjusting the distance between the first and second joints.

The first movable element may comprise a first roll configured for rolling along a first guiding surface when the first element is moved by the force, said first surface being parallel to the first axis. This may be a convenient way of guiding at least a part of the first element when it moves as a result of the force applied to it. The first roll may have a rotational axis which is fixed in relation to a section of the first element. This implies that the roll is not allowed to move along the first element, but is fixed to a section of the element. If the first element is divided into different parts as mentioned above, the section to which the roll is attached may be e.g. the first part or the second part or to the joint joining the first and second parts.

The second movable element may comprise a second roll configured for rolling along a second guiding surface when the second element is moved by the force, said second surface being parallel to the second axis. This may be a convenient way of guiding at least a part of the second element when it moves as a result of the force transmitted from the first element. The second roll may have a rotational axis which is fixed in relation to a section of the second element. This implies that the roll is not allowed to move along the second element, but is fixed to a section of the element. If the first element is divided into different parts, the section to which the roll is attached may be any of such parts or to the joint joining the first and second elements in which case the second roll may be attached to both the first and the second element.

In some embodiments of the present invention, the switch is configured for the electrical circuit being a high current electrical circuit, preferably for a current of at least 1000 Amperes. By means of the variable movement/speed (gear) ratio provided by the present invention, the movable contact may easily be more firmly pressed against the fixed contact, reducing the resistance and thus the heat generation at the interface between the contacts. In this way, losses may be reduced and a higher current may be used without reducing the usability due to a too high temperature. Exemplifying embodiments of the present invention may conveniently be used for circuits with currents of at least 1000 A, at least 1500 A or at least 2000 A, such as between 2000 A and 3500 A.

As discussed herein, a force may be applied to the first element in order to move the movable contact. The same force, possibly with a higher, lower or the same size as during the movement, may then be used to hold the movable contact in place against the fixed contact. In some embodiments of the present invention, the movable contact may be separated from the fixed contact automatically if the applied force is removed (discontinued), e.g. by turning off the actuator (e.g. electromagnet) generating the force. The separation may e.g. be by act of gravity or by means of a return spring linked to the movable contact.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second" etc. for different features/components of the present disclosure are only intended to distinguish the features/components from other similar features/components and not to impart any order or hierarchy to the features/components.

BRIEF DESCRIPTION OF THE DRAWINGS

The invention is now described, by way of example, with reference to the accompanying drawings, in which.

DETAILED DESCRIPTION OF THE INVENTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

When it is herein stated that axes or directions are at an angle to each other, or forms an angle, or the like, it is meant that the axes or directions are not parallel to each other.

When it is herein stated that a force has a direction, it is the direction of the total force, not a component of the force, that is intended, unless otherwise specified.

The first and second elements may be regarded as at least part of a transmission arrangement for transmitting the force applied to the first element to movement of the movable contact.

Figure 1:
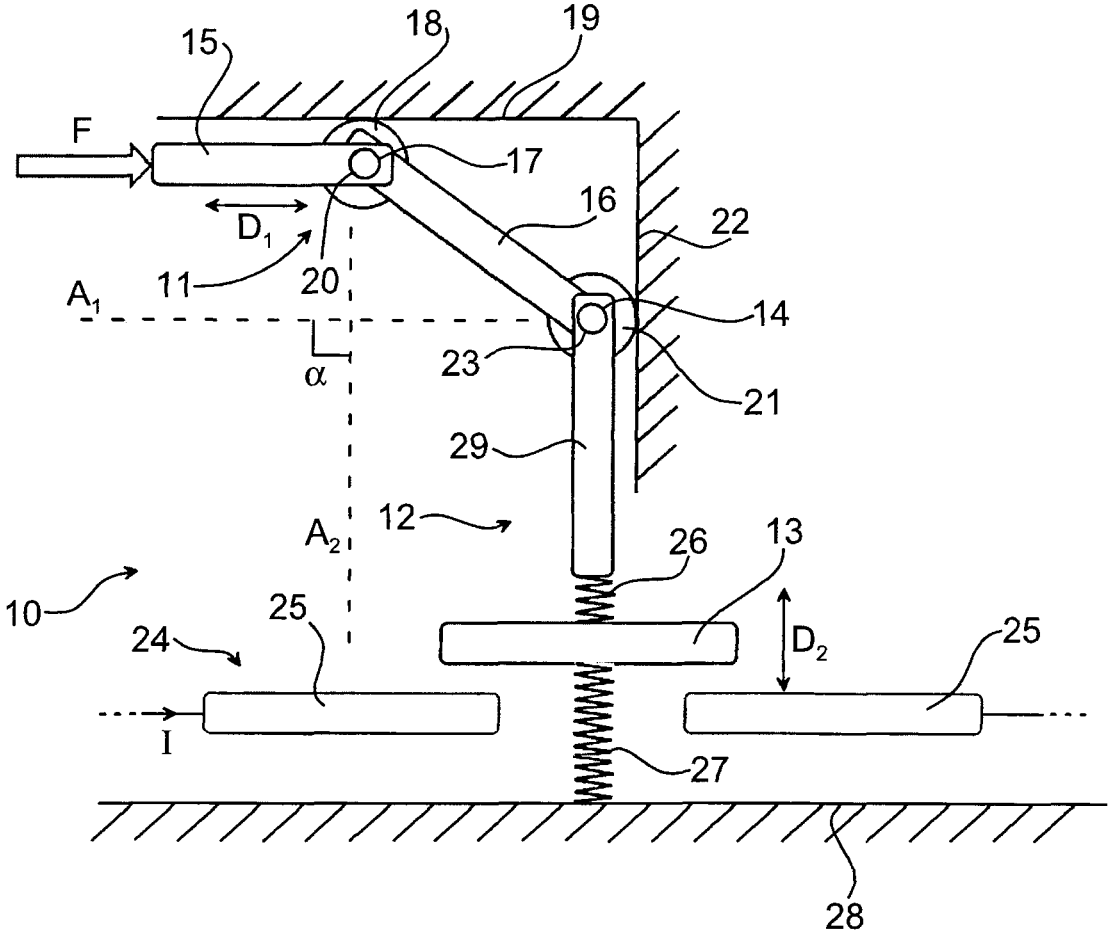
FIG. 1 is a schematic side view of an embodiment of a switch of the present invention.

FIG. 1 illustrates an embodiment of a contactor switch 10 of the present invention.

The contactor 10 comprises a first element 11 which is configured to be acted on by a force F. In the embodiment of FIG. 1, the first element is configured for the force F being applied at an end of a first part 15 of the first element 11. The first part 15 may e.g. be a metal core acted on by a coil electromagnet (not shown), or the force F may be transmitted to the first part 15 from such a core. The first part 15 is configured to move in a parallel to the first axis A1 to-and-fro in opposing directions as indicated by the double-headed arrow D1 in the figure. The first part 15 of the first element 11 is pivotally arranged to a second part 16 of the first element 11. The first part 15 is pivotally arranged to the second part 16 by the parts being attached to each other in a joint 17. The joint 17 and its pivot axis is stationary in relation to the first and second parts of the first element and thus not slidable along any of the first and second parts. A first roll 18 is comprised in the first element 11, attached at the joint 17. The first roll 18 has a rotation axis 20 which is stationary in relation to the section of the first element 11 to which it is attached. In the embodiment of FIG. 1, the rotation axis 20 essentially coincides with the pivot axis of the joint 17. The first roll 18 rests against a first guiding surface 19 along which it is configured to roll as the first element 11 moves as a result of the applied force F. The first guiding surface 19 is preferably parallel to the first axis A1.

The second part 16 of the first element 11 is, as stated above, pivotally attached to the first part 15 of said first element 11, but also pivotally arranged/attached to a first part 29 of the second element 12 at a first joint 14. The second part 16 separates the two pivot joints 17 and 14 from each other, functioning to regulate the variable ratio between the, in the present figure, horizontal speed of the first part 15 of the first element 11 and the vertical speed of the second element 12. The second part 16 of the first element 11 may e.g. be shaped as a rod, joined to the first part 15 of the first element 11 with the joint 17 at a first end of the rod 16 and joined to the first part 29 of the second element 12 with a joint 14 at a second end of the rod 16. In order to electrically insulate the force transmission parts and the actuator from the electrical current I of the electrical circuit 24 controlled by the contactor 10, the second part 16 of the first element 11, as well as the first part 29 of the second element 12, may be formed from an electrically insulating material, such as at least one insulating rigid plastic material.

The first part 29 of the second element 12 is pivotally arranged/attached to the second part 16 of the first element 12. The first part 29 of the second element 12 is pivotally arranged to the second part 16 of the first element 11 by the parts being attached to each other in a joint 14. The joint 14 and its pivot axis is stationary in relation to the first part 29 of the second element 12 and the second part 16 of the first element 11 and thus not slidable along any of the first and second parts. A second roll 21 is comprised in the second element 12, attached at the joint 14. The second roll 21 has a rotation axis 23 which is stationary in relation to the section of the second element 12 to which it is attached. In the embodiment of FIG. 1, the rotation axis 23 essentially coincides with the pivot axis of the first joint 14. The second roll 18 rests against a second guiding surface 22 along which it is configured to roll as the second element 12 moves as a result of the applied force F. The second guiding surface 22 is preferably parallel to the second axis A2.

At least one contact spring 26 may be attached to and between the first part 29 of the second element 12 and the movable contact 13. If the first part 29 is rod shaped, the first joint 14 may be at a first end of the rod 29 and the contact spring 26 may be attached at a second end of the rod 29. The three parts (herein discussed) of the second element 12, the first part 29, the contact spring 26 and the movable contact 13, may be sequentially arranged in line parallel to the second axis A2. The contact spring 26 is configured to press the movable contact 13 against the fixed contact 25 with a relatively even pressure in order to avoid unintentional circuit break or unnecessary heat generation due to e.g. uneven force F or vibrations or the like in the contactor 10.

The movable contact 13 is comprised in the second element 12 and configured to be moved by means of the applied force F in a direction to-and-fro as indicated by the double-headed arrow D2 in parallel to the axis A2. In the embodiment of FIG. 1, the movable contact 13 moves vertically downwards as a result of the horizontally applied force F applied on the first part 15 of the first element 11. This is because the axes A1 and A2 are at an angle $\alpha$ to each other, in this example at about 90° angle $\alpha$ to each other. As the movable contact 13 moves down, it will come into contact with the fixed contact 25, here comprising two parts 25 which are put in electrical connection with each other by the movable contact 13, whereby the electrical circuit 24 is closed allowing electricity to flow via the movable contact 13.

At least one return spring 27 may be linked to the movable contact 13 such that the return spring 27 may act to separate the movable contact 13 from the fixed contact 25 when the force F is removed, discontinued or sufficiently reduced. As shown in FIG. 1, the return spring may be attached to and between the movable contact 13 and a base surface 28. Typically, the return spring 27 is substantially weaker than the contact spring 26, to avoid that the contact spring 26 is substantially compressed by the return spring 27 before the movable contact comes into contact with the fixed contact 25. However, the return spring 27 is strong enough to separate the movable contact 13 from the fixed contact 25 and thus also strong enough to move the first and second elements 11 and 12. In the embodiment of FIG. 1, this means the return spring 27 working vertically against gravity. However, by means of the present invention where some parts of the mechanical transmission arrangement is not arranged vertically above the movable contact 13 and the return spring 27, the strength requirements put on the return spring 27 are reduced and the return spring may also be able to faster and more easily separate the contacts from each other, reducing the electrical arc energy between the contacts, reducing the wear of the contacts and thus improving the electrical lifetime of said contacts. Thus, both the electrical and mechanical lifetimes of the contacts may be improved with the present invention. Also, since the return spring has a lower load, the switch 10 may be more robust and less sensitive to external chocks and vibrations.

As can be seen in the figure, by means of the present invention, it will be easier to hold the movable contact 13 in place, closing the circuit, since the guiding surface 19 will cooperate with the force F to keep the movable contact 13 in the closed position. Thus, the size of the force F may be reduced and/or the movable and fixed contacts may be pressed together at increased force, reducing contact resistance, compared with the state of the art.

Figure 2:
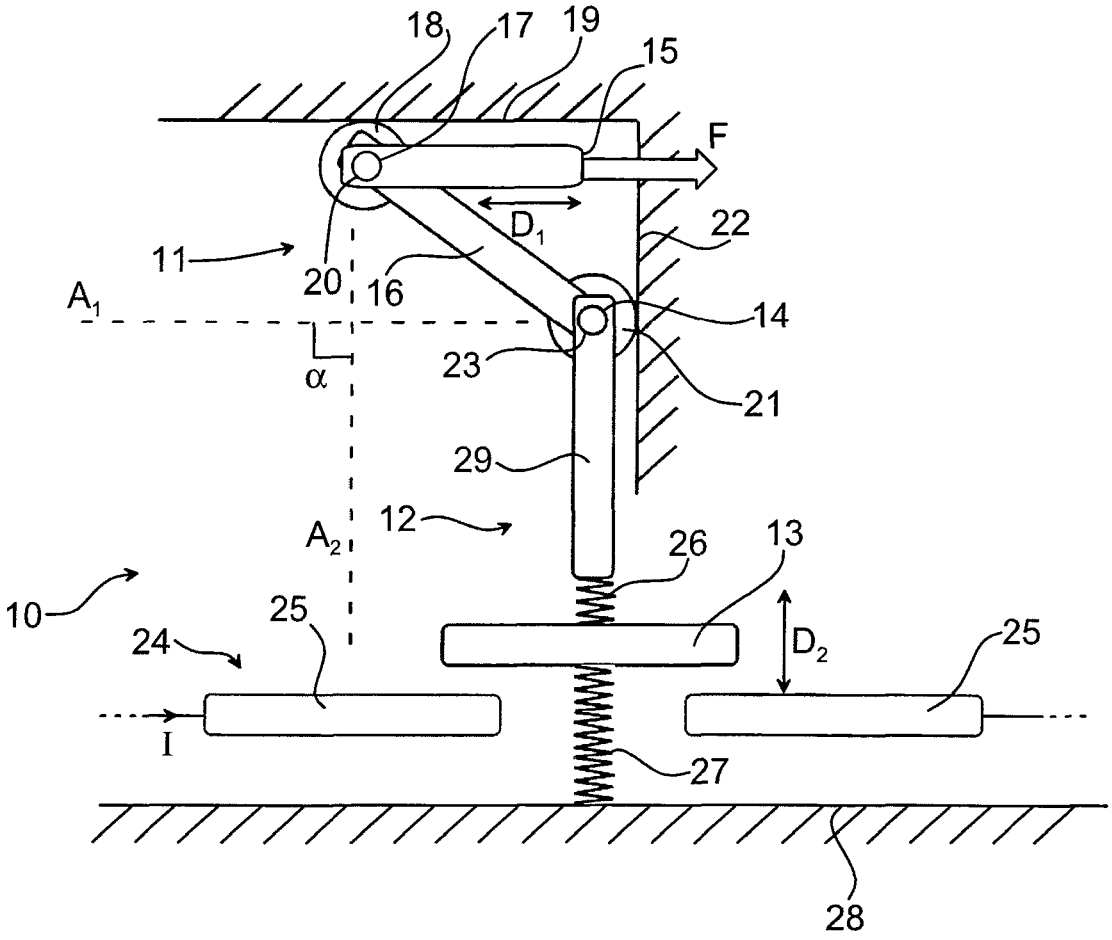
FIG. 2 is a schematic side view of another embodiment of a switch of the present invention.

FIG. 2 illustrates another embodiment of a contactor switch 10 of the present invention. What differs from the embodiment of FIG. 1 is that the first element 11 is designed such that an applied force pulls on the first part 15 of the first element 11, instead of pushes as in the embodiment of FIG. 1, in order to move the movable contact 13 towards the fixed contact 25. The design is such that an acute angle is formed at the second joint 17 between the first and second parts 15 and 16 of the first element 11, instead of an obtuse angle as in the embodiment of FIG. 1. As illustrated by FIGS. 1 and 2 the force applied may be either or both of a pushing and a pulling force, depending on the design of the mechanical transmission of the elements 11 and 12.

By adjusting e.g. the angle $\alpha$ between the axes A1 and A2, and thus between the guiding surfaces 19 and 22, the gear ratio (movement speed of the first part 15 of the first element 11 in relation to the movement speed of the second element 12 towards the fixed contact 25), and the change in gear ratio, may be adjusted as desired. Additionally or alternatively, the gear ratio may be adjusted by adjusting the design of the transmission elements 11 and 12, e.g. by adjusting the distance between the first and second joints 14 and 17 and/or between the rotation axes 20 and 23 of the first and second rolls 18 and 21.

FIGS. 1 and 2 illustrate two different embodiments of an electrical circuit switch with a variable gear ratio, but it is realised from the present disclosure that many other designs are possible within the scope of the present teachings to obtain the variable gear ratio.

Figure 3:
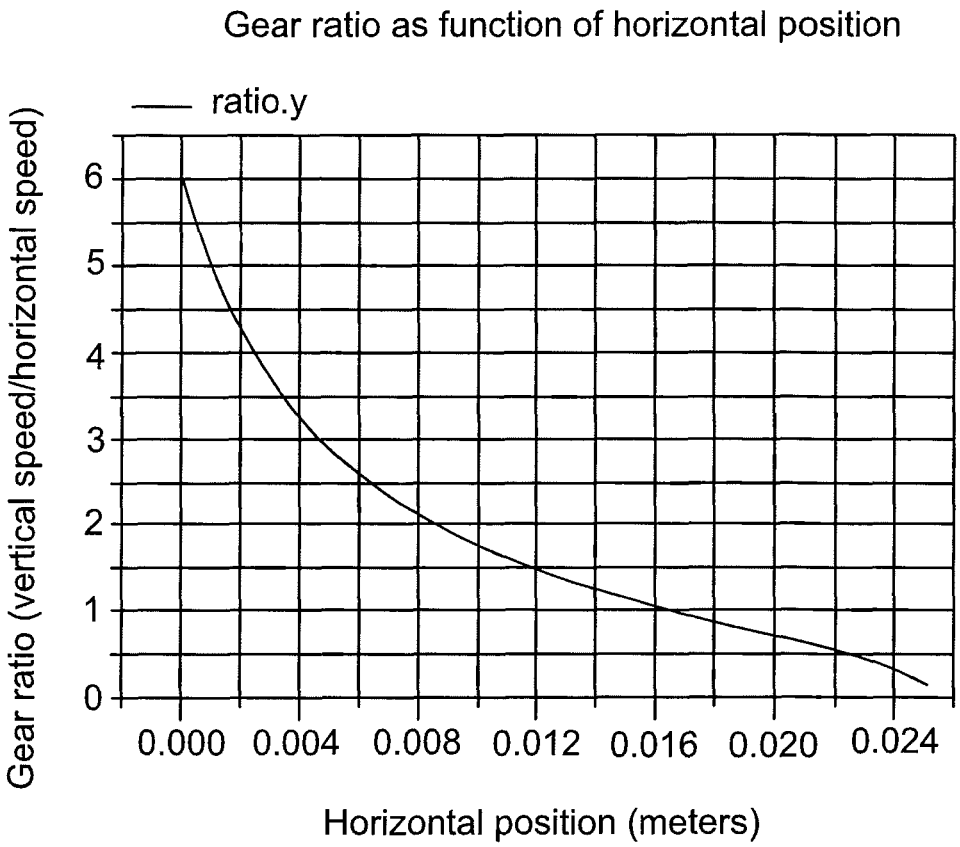
FIG. 3 is a diagram showing the gear ratio as a function of movement in the direction of the applied force in an embodiment of a switch of FIG. 1 or 2.

FIG. 3 is a graph of values of the gear ratio for a contactor 10 as illustrated in FIG. 1 or FIG. 2. The graph shows the gear ratio as a function of the position of the first part 15 of the first element 11 of the mechanical transmission. The position is given as the distance in meters from the start position of 0.000 meters, furthest to the left of the stroke length of the first part 15 in FIGS. 1 and 2. The gear ratio is calculated as the vertical speed of the movable contact 13 in the direction D2 parallel to the axis A2 towards the fixed contact 25, divided by the horizontal speed of the first part 15 in the first direction D1 (towards the right in the FIGS. 1 and 2) parallel to the first axis A1. As is seen in the graph, the gear ratio starts at 6, i.e. the vertical speed of the movable contact is 6 times the horizontal speed of the first part 15 (the start ratio of course depends on the start position chosen). Then, the gear ratio is gradually (exponentially) reduced to end at 0.2 when the movable contact 13 comes into contact with the fixed contact 25. It may be convenient to use only a part of the stroke (gear ratios) shown in the graph, e.g. the part with a gear ratio of between 2:1 and 1:2. In this way the mechanical wear on the contacts is reduced due to the low impact speed of the contacts, while the overall time period for the contactor to close the circuit 24 may be the same or even reduced, compared with a linear 1:1 ratio throughout the stroke. In this example, a stroke length of 25 mm is used, but the same principles are valid also for other stroke lengths.

Figure 4:
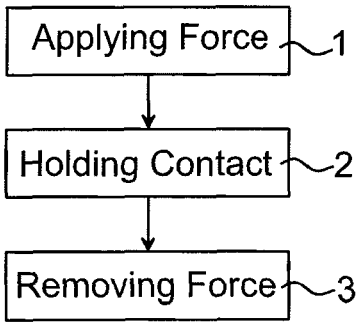
FIG. 4 is a schematic flow chart of an embodiment of a method of the present invention.

FIG. 4 is a schematic flow chart of an embodiment of a method of the present invention. A force F is applied (step 1) to a first movable element 11 in a direction D1 parallel to a first axis A1, such that the force F is transmitted to a second element 12 via a first joint 14 and moves a movable contact 13 of the second element 12 in parallel to a second axis A2 and into contact with a fixed contact 25, thereby closing an electrical circuit 24. The first axis A1 forms an angle α to the second axis A2. The movable contact 13 is held (step 2) in contact with the fixed contact 25 by means of the applying of the force F to the first element 11. If suitable, the size of the force F may be reduced, increased or the same as when moving the movable contact 13. In order to save energy used for pressing the contacts together, the force F may in some embodiments be reduced since a guiding surface 19 may cooperate with the force F to hold 2 the contacts together (e.g. the coil energy of an electromagnet used for creating the force F may be reduced). However, in order to reduce the contact resistance and heating (thus reducing energy loss in the electrical circuit 24), the force F may be increased after the movable contact has contacted the fixed contact in order to increase the contact force between the movable and fixed contacts. In order to open the circuit 24 again, the force F applied to the first element 11 may be removed (step 3), whereby e.g. a return spring 27 may be able to separate the movable contact 13 from the fixed contact 25, thereby opening the electrical circuit 24 and interrupting the current I therein.

The invention has mainly been described above with reference to a few embodiments. However, as is readily appreciated by a person skilled in the art, other embodiments than the ones disclosed above are equally possible within the scope of the invention, as defined by the appended patent claims.

What is claimed is:

1. An electrical circuit switch comprising:

a first movable element configured to move in parallel along a first axis of said first moveable element in response to a force applied to said first movable element, said force having a direction parallel to the first axis; and a second movable element comprising a movable contact and being configured to, by means of said force, move said movable contact in a direction parallel to a second axis between an open position and a closed position, corresponding to the switch opening or closing an electrical circuit;

wherein the first axis forms an angle to the second axis; and wherein the first movable element and the second movable element are pivotally connected to each other in a first joint.

2. The switch of claim 1, wherein the switch is a contactor.

3. The switch of claim 1, wherein the first axis forms a right angle to the second axis.

4. The switch of claim 1, wherein the force applied to the first element is an electromagnetic force.

5. The switch of claim 1, wherein the first movable element comprises a first part and a second part, the first and second parts being pivotally connected to each other in a second joint, wherein the first part is configured for having the force applied to it and the second part is pivotally connected to the second element in the first joint and able to transmit the force from the first part to the second element via the second and first joints.

6. The switch of claim 1, wherein the first movable element comprises a first roll configured for rolling along a first guiding surface when the first element is moved by the force, said first surface being parallel to the first axis.

7. The switch of claim 6, wherein the first roll has a rotational axis which is fixed in relation to a section of the first element.

8. The switch of claim 1, wherein the second movable element comprises a second roll configured for rolling along a second guiding surface when the second element is moved by the force, said second surface being parallel to the second axis.

9. The switch of claim 8, wherein the second roll has a rotational axis which is fixed in relation to a section of the second element.

10. The switch of claim 1, wherein the switch opens or closes a high current electrical circuit for a current of at least 1000 A.

11. The switch of claim 1, further comprising at least one return spring attached to the movable contact such that said at least one return spring is configured to separate the movable contact from a fixed contact.

12. The switch of claim 1, further comprising at least one contact spring attached to and between the second movable element and the movable contact, said at least one contact spring being configured to press the movable contact against a fixed contact with substantially even pressure.

13. The switch of claim 1, further comprising:

at least one return spring attached to the movable contact such that said at least one return spring is configured to separate the movable contact from a fixed contact; and at least one contact spring attached to and between the second movable element and the movable contact, said at least one contact spring being configured to press the movable contact against the fixed contact;

wherein said at least one return spring is weaker than said at least one contact spring.

14. A method of operating an electrical circuit switch comprising a first movable element pivotally connected to a second movable element in a first joint, the method comprising:

applying a force to the first movable element in a direction parallel to a first axis of the first movable element to move the first movable element in parallel along the first axis, such that the force is transmitted to the second element via the first joint and moves a movable contact of the second element in a direction parallel to a second axis and into contact with a fixed contact, thereby closing an electrical circuit, wherein the first axis forms an angle to the second axis; and holding the movable contact in contact with the fixed contact by means of applying the force to the first element.

15. The method of claim 14, further comprising:

removing the force applied to the first element, whereby a return spring is configured to separate the movable contact from the fixed contact, thereby opening the electrical circuit and interrupting the current therein.

16. The method of claim 14, wherein the step of holding the movable contact in contact with the fixed contact includes using a contact spring attached between the second movable element and the movable contact to press the movable contact against the fixed contact with substantially even pressure.

17. An electrical circuit switch comprising:

a first movable element configured to move in parallel along a first axis of said first moveable element in response to a force applied to said first movable element, said force having a direction parallel to the first axis; and a second movable element comprising a movable contact and being configured to, by means of said force, move said movable contact in parallel to a second axis between an open position and a closed position, corresponding to the switch opening or closing an electrical circuit;

wherein the first axis forms an angle to the second axis; and wherein the first movable element and the second movable element are pivotally connected to each other in a first joint;

wherein the first movable element and second movable element provide a gear ratio which varies during movement of said movable contact between the open position and the closed position, corresponding to the switch having a speed which changes as it opens or closes the electric circuit.

* * * * *